United States Patent [19]

Rocquin

[11] Patent Number: 4,502,722

[45] Date of Patent: Mar. 5, 1985

[54] DEBRIS PICKER WITH INTERCHANGEABLE TIPS

[76] Inventor: Camille J. Rocquin, 1410 Demosthenes St., Metairie, La. 70005

[21] Appl. No.: 497,367

[22] Filed: May 23, 1983

[51] Int. Cl.[3] ..... B01B 1/00

[52] U.S. Cl. ..... 294/61

[58] Field of Search ..... 294/61, 19 R, 50, 50.5, 294/50.6, 110 A, 65.5, 65 R, 24, , 2, 10, 14, 20, 33

[56] References Cited

U.S. PATENT DOCUMENTS

| | | | |
|---|---|---|---|
| 2,642,306 | 6/1953 | Beeler | 294/61 |
| 3,932,953 | 1/1976 | Sharp | 294/61 |
| 3,971,543 | 7/1976 | Shanahan | 294/65.5 |
| 4,183,570 | 1/1980 | Broyles et al. | 294/61 |
| 4,359,240 | 11/1982 | Woeber | 294/61 |

*Primary Examiner*—James B. Marbert

*Attorney, Agent, or Firm*—Bode & Smith

[57] ABSTRACT

A device for picking up rubbish and debris and removal of the rubbish and debris into a proper receptacle without the necessity for the operator of the device to touch the rubbish and debris. The shaft has a handle at one end, a pointed tip at the other end and a sleeve slidably engaged on the shaft to cause removal of the debris and rubbish collected on the pointed tip. When a locking and release mechanism located near the handle on the shaft is released, the sleeve causes removal of the rubbish and debris when it slides down the shaft and over the tip.

6 Claims, 5 Drawing Figures

DEBRIS PICKER WITH INTERCHANGEABLE TIPS

BACKGROUND OF THE INVENTION

1. Field of the Invention

The present invention relates to pick-up devices. More particularly, the present invention relates to a device having interchangeable tips that allow the removal of debris by an exterior collar slidable over the tip of the apparatus.

2. General Background

It is well known that a suitable material such as aluminum or wood in the form of a long tubular section with a handle at one end and some type of pointed tip at the other end can be used for picking up paper and rubbish on the ground.

It is also known that some method of aiding in removal of the rubbish from the tip may be employed in conjunction with the tubular section.

U.S. Pat. No. 3,873,143 issued to Foust, discloses a pick-up device with a tubular body that houses a pointed pick-up member which retracts into the tubular body.

U.S. Pat. No. 1,234,794 issued to Orson, and U.S. Pat. No. 3,183,031 issued to Haberstick, and U.S. Pat. No. 2,642,306 issued to Beeler all disclose pick-up devices with a pointed pick-up end that can be caused to retract into a tubular body.

U.S. Pat. No. 2,228,690 issued to Crary discloses a pick-up device with a single stationary pointed tip. Rubbish is removed from the tip by means of a flat piece of metal slidably mounted onto the main body and bent and drilled so that the tip passes through the hole in the metal piece. The metal piece must be manually moved from a stop, such as a screw, to allow the metal piece to move downwardly around the tip by spring pressure.

U.S. Pat. No. 2,804,336 issued to Thompson discloses a pick-up tool with interchangable multiple tips mounted on the tool by threaded engagement. A plate, fitted around the multiple tips and in a normal upward position, can be caused to move downwardly around the tips by movement of a pivoting lever in the handle of the tool. The cited references fall short in some areas however. The present invention overcomes the shortcomings by being relatively simple in operation and design while efficiently carrying out its intended purpose. This is accomplished with a minimum of moving parts and a provision for easily and quickly changing tips when necessary.

GENERAL DESCRIPTION OF THE PRESENT INVENTION

The present invention provides a novel device for picking up litter and debris and removal of the litter by a simple and straightforward manner. What is provided is an apparatus having a tubular shaft with a handle mounted on a first end of the shaft and the second end of the shaft having an innertapering hollow portion for receiving one of a plurality of interchangeable tips. Each interchangeable tip is maintained in position with the receiving end by frictional engagement. A side slot is provided in the receiving end so that a wedge may be inserted to cause loosening and removal of the tip. The tubular shaft is encased in a sleeve mounted on the shaft. Stops are provided on the shaft to prevent the sleeve from sliding off the shaft yet still allowing the lower end of the sleeve to slide no further than the tip engaged at the lower end of the shaft. A locking and releasing device is provided at the end of the shaft nearest the handle so that the sleeve may be retained in its upper position with the tip exposed. After collection of rubbish on the tip movement of the sleeve downward automatically removes the rubbish from the tip. An additional embodiment provides a spring intermediate the sleeve and shaft for automatically causing the sleeve to move downward, thus removing any debris from the tip. The sleeve, in the up position, is maintained there by the use of the lock and release device against the bias of the spring.

Therefore, it is an object of the present invention to provide a device with interchangeable tips which allows easy pick-up of rubbish from the ground and placement of the rubbish in a proper receptacle.

It is a further object of the present invention to provide a device which allows such pick-up and removal to be conducted in a single-handed operation so that contact with the rubbish is unnecessary.

DETAILED DESCRIPTION OF THE PREFERRED EMBODIMENT

Figure 4:
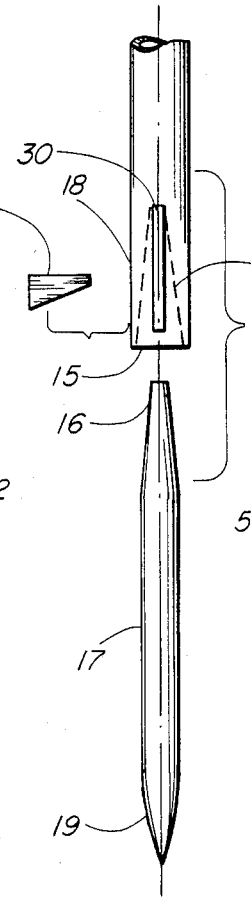
FIG. 4 is a partial view of the lower end of the device with the interchangeable tip removed and illustrates the slot, the innertapering portion as illustrated by the dotted lines for receiving the interchangeable tip and the wedge which is used for removing the tip.

The device is generally referred to in the drawings by the numeral 10. A hollow tubular shaft 12, made of a rigid structure, such as metal, has a handle 14 affixed to one end of shaft 12 by threaded engagement, glue or the like. At the other end of shaft 12 there is provided receptacle 18 by welding or the like. Receptacle 18 provides a cylindrical bore 15 (as illustrated in FIG. 4 in phantom view) which tapers inwardly toward handle 14 to receive tapered end 16 of interchangeable tip 17. End 19 of tip 17 is circular with a slight taper so that end 19 of tip 17 is of slightly less circumference that the middle portion of tip 17. The outer diameter of tapered end 16 of tip 17 is substantially equal to the inner diameter of bore 15. The cylindrical walls 21 of bore 15 engage tapered end 16 of tip 17 as tapered end 16 is inserted therein. Tip 17 is forced past the point at which the circumference of tapered end 16 matches that of bore 15 so that tip 17 is frictionally engaged and securely seated in bore 15.

Figure 5:
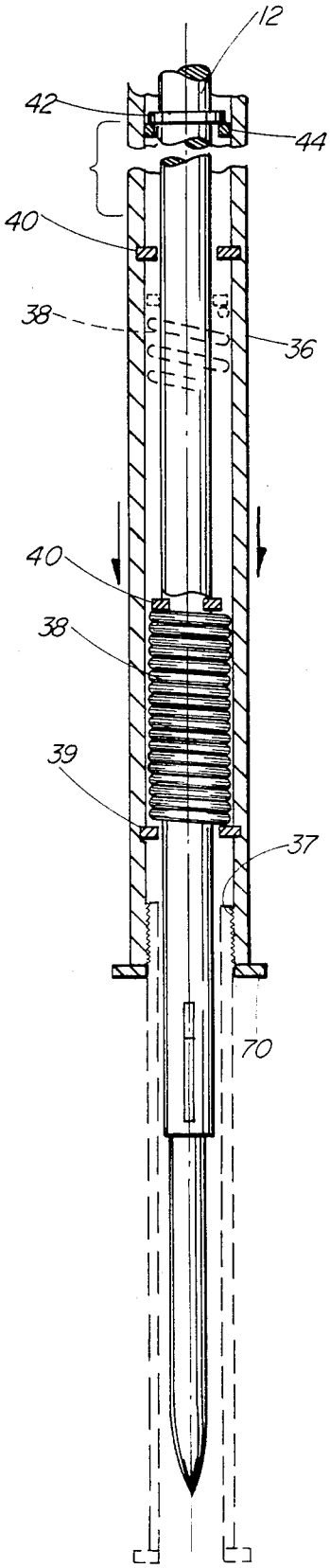
FIG. 5 shows a cut-away view of the lower end of an alternate embodiment of the device and illustrates the stops used on the sleeve and the shaft for retaining a spring in place.

FIG. 5 illustrates the positioning of tip 17 within end bore 15 as it would appear rigidly engaged therein.

Illustrated in FIG. 4 is slotted port 30 which extends through the side wall of receptacle 18 into cylindrical bore 15. Slotted port 30 is positioned on receptacle 18 so that the upper end of tapered end 16 is positioned adjacent the upper portion of slotted port 30 when tip 17 is securely seated within bore 15. When it is desired to remove tip 17 from receptacle 18, wedge 31 is slipped into slotted port 30 and tapped to move tip 17 down, thus disengaging tip 17 from bore 15. Each tip used with device 10 would be adapted in such a manner as that illustrated and explained above so that easy insertion and removal from receptacle 18 could be accomplished with various tips.

An alternate embodiment of tip 17 may be provided where tip 17 is magnetized. The alternate embodiment would be used to pick up metallic debris which cannot be speared.

Figure 1:
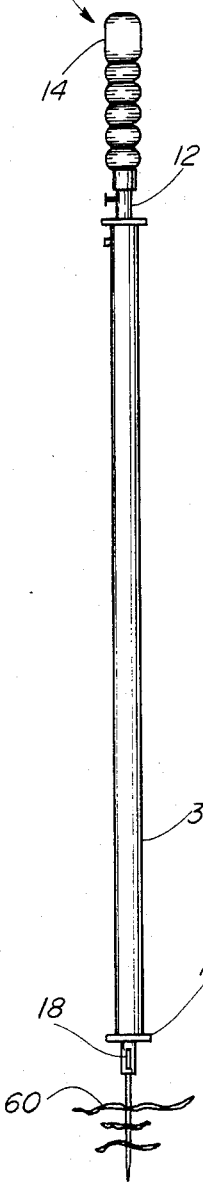
FIG. 1 shows a side view of the device as it would appear with the sleeve retracted in position for picking up rubbish.

As illustrated in FIG. 1, a major portion of shaft 12 is enclosed within sleeve 36, which is constructed of a suitable material such as metal. The inner diameter of sleeve 36 is larger than the outer diameter of shaft 12 and tip 17 and the receptacle 18 so that sleeve 36 is slidable over shaft 12, tip 17 and sleeve 18.

Figure 2:
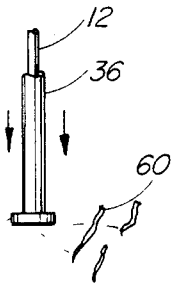
FIG. 2 is a partial view of the device as it would appear with the sleeve extended for the removal of rubbish.

Outer collar 70, attached at the lower end of sleeve 36, serves mainly to force rubbish 60 collected on tip 17 downwardly and off of tip 17 when sleeve 36 slides down shaft 12 a sufficient distance so that tip 17 is surrounded by sleeve 36, as illustrated in FIG. 2. The downward force of sleeve 36 is caused by the weight of sleeve 36 and/or manual pressure by the operator.

FIG. 5 illustrates an alternate embodiment of apparatus 10 where the downward force of sleeve 36 is caused by pressure from spring 38. The size of spring 38 is such that it fits inside of sleeve 36 and around shaft 12. Spring 38 is positioned between and held in place by inner collar 39 on sleeve 36 and outer collar 40 on shaft 12.

Spring 38 is compressed to create the downward pressure necessary for removal of rubbish 60 from tip 17 when sleeve 36 is retracted to expose tip 17 and locked in the retracted position. Sleeve 36 is held in the retracted position by a locking mechanism which will be described at a later point.

Sleeve 36 is prevented from sliding completely off of shaft 12 by collar 42 on shaft 12 and upper inner collar 44 on sleeve 36 as illustrated in FIG. 5. Collar 42 and upper inner collar 44, respectively, extend outwardly from shaft 12 and inwardly from sleeve 36 such that their outer edges overlap. This limits the distance that sleeve 36 can slide down shaft 12 thus preventing sleeve 36 from coming off shaft 12 while still allowing sleeve 36 to move a sufficient distance down shaft 12 to cause removal of rubbish 60 from tip 17.

In the preferred embodiment locking mechanism 50 is similar to that used in umbrellas for automatic locking and release. Locking mechanism 50 comprises a piece of rigid material, such as metal positioned in the hollow of shaft 12. Release mechanism 50 is pivoted near its middle point on pin 52 which is mounted through shaft 12. At one end of locking mechanism 50 release buttom 54 extends outwardly through slot 51 in shaft 12. At the other end of locking mechanism 50 is elevated edge 55 which protrudes in a direction substantially opposite from that of release button 54. Locking mechanism 50 is positioned in shaft 12 so that elevated edge 54 extends through slot 53 in shaft 12 and locking mechanism 50 is in its normal locking position. Locking mechanism 50 is biased in its normal locking position by spring 56, which is positioned opposite the release button 54 of locking mechanism 50 against the inner wall of shaft 12. Elevated edge 55 engages slot 80 of sleeve 36 to maintain sleeve 36 in its upper position, thus keeping tip 17 exposed. When release button 54 is pushed inwardly, elevated edge 55 is disengaged from slot 80 and sleeve 36 is released to slide down shaft 12 and over tip 17, thus resulting in collar 70 forcing rubbish 60 collected on tip 17 to be removed from tip 17 as seen in FIG. 2 and in phantom view in FIG. 5. In operation, the operator of device 10 manually returns sleeve 36 to its upper locked position, exposing tip 7, and spears rubbish 60 on the ground. When tip 17 is filled to a reasonable capacity, the operator pushes release button 54 so that the rubbish 60 is automatically expelled into a proper receptacle and the procedure is then repeated.

Figure 3:
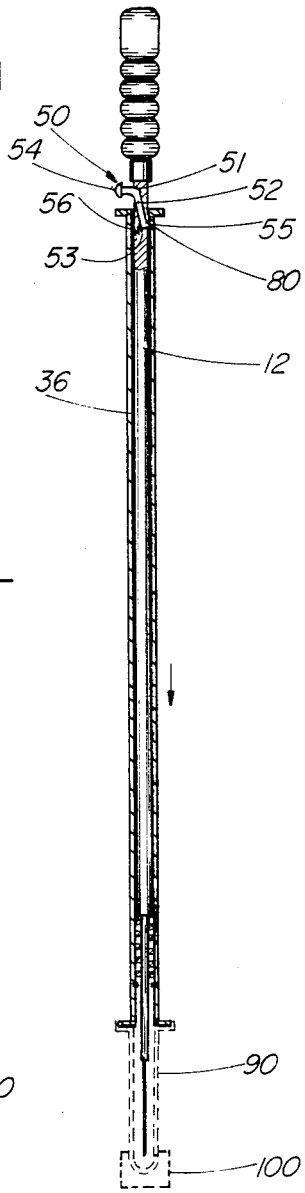
FIG. 3 shows a cut-away view of the device and illustrates the means by which the locking and releasing mechanism retains and releases the sleeve mounted on the shaft.

Illustrated in FIG. 3 in phantom view is protective cap 90. Cap 90 is threadably engageable to threads 37 (seen in FIG. 5) on the inside of shaft 36. Cap 90 is adapted at its lower end to receive rubber tip 100. Cap 90 thus serves two purposes. First, it serves to protect tip 17 from damage when apparatus 10 is not in use and it also allows apparatus 10 to be used as a walking stick.

Although the description of the preferred embodiment describes specific elements for practicing the invention, they should not be read in a limiting sense so as to limit the scope of the invention.

What is claimed as invention is:

1. An apparatus with interchangeable tips for picking up debris, which comprises:

a. a hollow tubular shaft having upper and lower ends;

b. handle means attached to the upper end of said shaft;

c. receiving means mounted on the lower end of said shaft for receiving in frictional engagement one of said interchangeable tips, wherein said receiving means further comprises:

i. a receptacle having a tapered cylindrical bore;

ii. a slot in the side wall of said receptacle which extends into said bore, and;

iii. means when insertable into said slot makes contact with the upper end of said tip forcing said tip out of engagement with said receptacle, disengaging said tip from said receptacle;

d. a sleeve slideably mounted on said shaft, slidable from a first upper position exposing said tip to a second lower position covering over said tip;

e. a first collar, mounted on the lower end of said sleeve, to force removal of debris collected on said tip when said sleeve is moved to said second position;

f. means for limiting the distance that said sleeve may slide down said shaft, which comprises:

i. a second collar, on the inner wall of said sleeve; and ii. a third collar, on said shaft, which moves to stopping engagement with said second collar limiting the sliding distance of said sleeve; and g. protective cap means threadably engageable onto the lower end of said sleeve, comprising:

i. a hollow protective cap portion, closed at its lower end and opened and threaded at its upper end for threadably engaging threads on said sleeve, said protective cap allowing movement of said tip within said cap yet precluding exposure of said tip outside of said cap; and ii. a rubber tip portion engageable on the outside of said closed end of said cap.

2. The apparatus in claim 1, further comprising a release button positioned in said shaft and biased in a normal locking position to retain said sleeve in said first position.

3. The apparatus in claim 2, further comprising magnetic interchangeable tips for picking up metallic debris.

4. An apparatus with interchangeable tips for picking up debris, which comprises:

a. a hollow tubular shaft having upper and lower ends;

b. handle means attached to the upper end of said shaft;

c. receiving means mounted on the lower end of said shaft for frictional engagement of said interchangeable tips, wherein said receiving means comprises:

i. a receptacle having a tapered cylindrical bore;

ii. a slot in the side wall of said receptacle which extends into said bore; and iii. a wedge insertable into said slot to cause removal of said tip from said receptacle;

d. a sleeve slidably mounted on said shaft slidable from a first upper position to a second lower position over said tip;

e. a first collar, on the lower outer wall of said sleeve, to cause removal of debris from said tip when said sleeve is in said second position;

f. means for limiting the distance that said sleeve may slide down said shaft, which comprises:

i. a second collar, on the inner wall of said sleeve; and ii. a third collar, on said shaft, which engages with said second collar to limit the sliding distance of said sleeve;

g. a release button positioned in said shaft and biased in a normal locking position to retain said sleeve in said first position; and h. biasing means to cause said sleeve to move from said first position to said second position, wherein said biasing means comprises:

i. a fourth collar, on the inner wall and proximate the lower end of said sleeve;

ii. a fifth collar on said shaft; and iii. a spring mounted on said sleeve and surrounding said shaft intermediate and biased between said fourth and fifth collars so that said spring is compressed when said sleeve is in said first position.

5. The apparatus of claim 3 wherein said interchangeable tip is pointed at its lower end for spearing debris.

6. The apparatus of claim 3 wherein said interchangeable tip is magnetized for picking up metallic debris.

* * * * *